United States Patent [19]

Gray

[11] 4,246,680

[45] Jan. 27, 1981

[54] JEWELRY CLASP

[76] Inventor: Ernest F. Gray, 3246 San Amadeo - Apt. 0, Laguna Hills, Calif. 92653

[21] Appl. No.: 97,139

[22] Filed: Nov. 26, 1979

[51] Int. Cl.[3] ..... A44B 19/00

[52] U.S. Cl. ..... 24/230 R; 24/230 AL; 24/265 WS; 24/201 HE; 24/73 J

[58] Field of Search ..... 24/230 R, 230 AL, 265 WS, 24/265 EC, 73 J, 201 HE

[56] References Cited

U.S. PATENT DOCUMENTS

| | | | |
|---|---|---|---|
| 1,232,733 | 7/1917 | Swedlund | 24/230 R |
| 1,414,838 | 5/1922 | Street | 24/230 R |
| 2,081,606 | 5/1937 | Sorkind | 24/230 R |
| 2,964,937 | 12/1960 | Lautin | 24/230 R |
| 3,225,406 | 12/1965 | Levy | 24/230 R |
| 3,299,679 | 1/1967 | Anderson | 24/73 J |
| 3,716,895 | 2/1973 | Fohr | 24/230 R |
| 3,848,299 | 11/1974 | Gray | 24/230 R |
| 3,967,351 | 7/1976 | Rosenberg et al. | 24/230 R |
| 4,024,607 | 5/1977 | Rosenberg et al. | 24/230 R |

*Primary Examiner*—Victor N. Sakran

*Attorney, Agent, or Firm*—Paul H. Gallagher

[57] ABSTRACT

The clasp is made up of two main parts - a box-like receptor, and a spring clip inserted into the receptor. The spring clip has a spring finger that has a free end engaging an end wall of the receptor for holding the parts in locked position, and the receptor includes a release member for releasing the spring finger, and thereby releasing the spring clip from locked position and enabling it to be withdrawn. The spring finger has a hump that pushes the release member back to inactive position as the spring finger is being inserted into the receptor, to prevent accidental movement of the spring finger to unlocked position, but the hump acts as a camming surface against which the release member works in the releasing movement.

4 Claims, 7 Drawing Figures

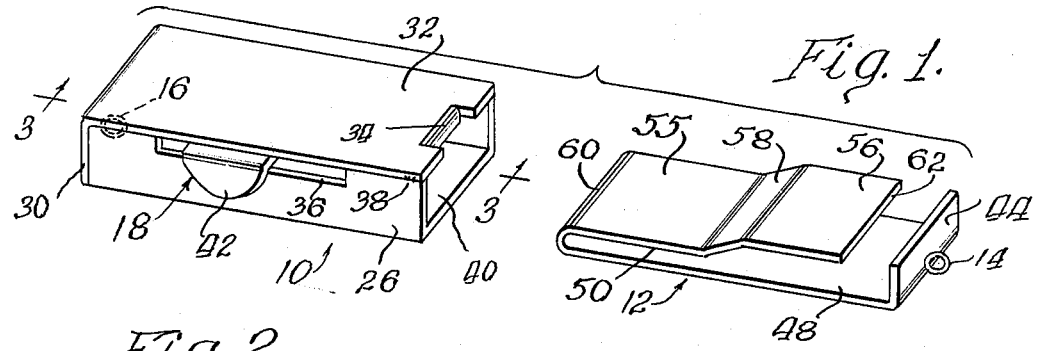
Fig. 1.
Fig. 2.
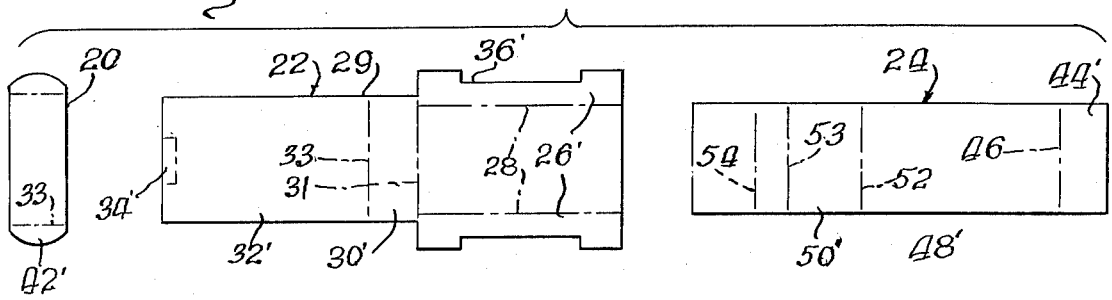
Fig. 3.
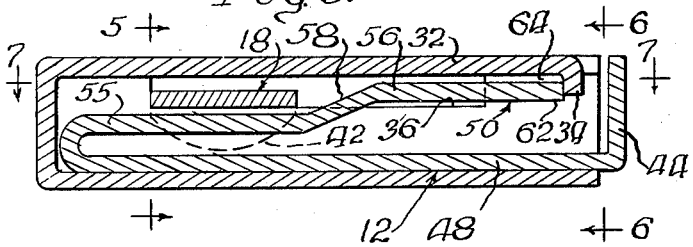
Fig. 5.
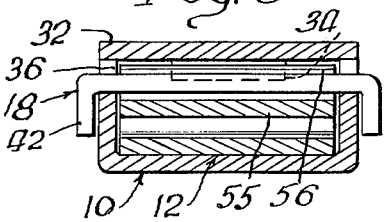
Fig. 4.
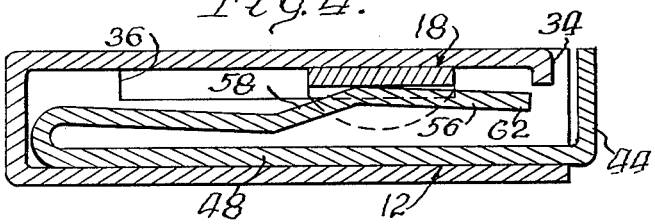
Fig. 6.
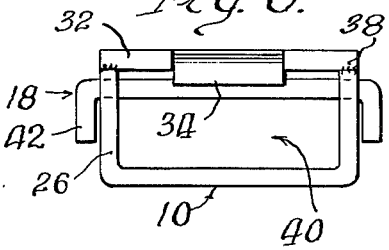
Fig. 7.
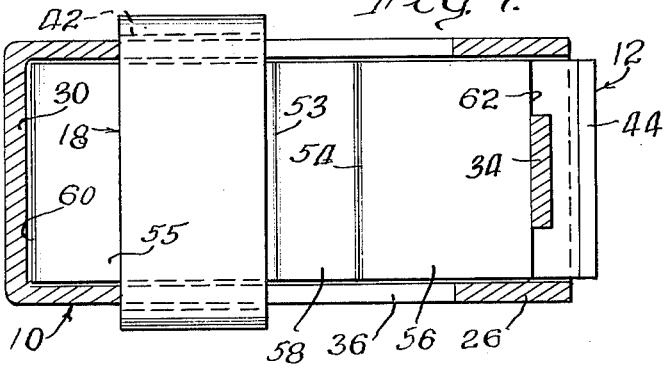

JEWELRY CLASP

CROSS REFERENCE

My prior U.S. Pat. No. 3,848,299, dated Nov. 19, 1974.

OBJECTS OF THE INVENTION

A main and broad object of the invention is to provide a clasp for items such as jewelry, having:

(a) novel construction effecting sure-locking of the parts with construction facilitating release from locking position;

(b) novel features to assure locking of the clasp and to avoid accidental jamming such as would prevent effective locking of the parts of the clasp;

(c) extremely simple construction and is correspondingly inexpensive;

(d) unusual effectiveness in its intended functioning;

(e) a good appearance, all of the working elements being substantially concealed, and there appearing from the exterior what appears to be a simple, polygonal box structure.

DESCRIPTION OF A PREFERRED EMBODIMENT

In the drawings:

FIG. 1 is a perspective view of the two main parts of the clasp shown in separated position;

FIG. 2 is a plan view of the sheet metal pieces from which the parts of the clasp are formed, shown in spread position;

FIG. 3 is a sectional view oriented according to line 3—3 of FIG. 1 but including the entire clasp in assembled and locked position;

FIG. 4 is a view similar to FIG. 3, but with the release member moved to advanced position in which the spring clip is in unlocked position;

FIG. 5 is a vertical cross-sectional view taken at line 5—5 of FIG. 3;

FIG. 6 is an end view of the receptor, as viewed at line 6—6 of FIG. 3 but with spring clip removed; and FIG. 7 is a horizontal sectional view oriented according to line 7—7 of FIG. 3.

Referring in detail to the drawings, the new clasp of the invention is shown in its entirety in FIG. 1 and includes two main parts, namely, a receptor 10 and a spring clip 12, being shown in perspective and separated position. These two main parts are connected to the opposite ends of a piece of jewelry such as a necklace, bracelet, etc., and to be held in place by the clasp. The parts of the clasp may be secured to the jewelry in any suitable manner, such as by the rings or loops 14, 16 on the parts. The loops 14, 16 are applied as by soldering them in place, and may be similar to those used in any jewelry and accordingly are disregarded in the following description of the construction of the clasp. The parts are assembled by inserting the spring clip 12 into the receptor 10, by moving the spring clip to the left as the parts are oriented in FIG. 1, and the parts interlock in a manner described in detail hereinbelow.

The parts of the clasp are made from sheet metal pieces shown in plan form in FIG. 2. The receptor 10 includes a release member 18 which is formed from a single piece of sheet metal 20 of FIG. 2; the receptor 10, other than the release member 18, is made from a single piece of sheet metal 22, and the spring clip 12 is made from a single piece of sheet metal 24. The sheet metal blanks of FIG. 2 are shown with dot-dash lines about which various parts of the blanks are folded to form corresponding elements in the completed item. The blank 22 has side portions 26' folded about the lines 28 to form side walls 26; a narrow portion 29 which includes a first portion 30' folded about the line 31 to form an end wall 30; the portion 29 includes a second, outer portion 32' folded about a line 33 to form a top wall 32; the outermost end of the portion 32' is cut at spaced points to form a tab 34' which is then bent down to form a stop element 34 in the finished product, this stop element functioning in retaining the spring clip in locked position; the side edges of the blank 22 are notched out as at 36' form side slots 36 in the finished item; in the completed item as thus described, the tip end of the portion 32 is soldered or welded to the adjacent side walls as indicated at 38 (FIGS. 1 and 6); the front end of the receptor is open as indicated at 40, except for the tab 34, for receiving the spring clip. The receptor 10 is therefore generally in the form of a box with a substantially open end.

The blank sheet metal piece 20, that forms the release member 18 is inserted into the slots 36 and the end portions 42' bent downwardly about the lines 43 exteriorly of the receptor, to form gripping elements 42 for gripping by the fingers for moving the release member.

The blank 24 is of uniform width, and includes an outer or front end portion 44', bent about a transverse line 46 to form a front end wall 44 in the finished item; it also includes a central portion 48' which forms a base 48; and a third portion 50' bent about a line 52 to form the spring finger 50; the portion 50' is further bent in opposite directions about lines 53, 54 to form lower and upper segments 55, 56 and an intermediate segment 58 which forms an abutment, and a camming element, referred to again hereinbelow. The segments 55, 56 may be substantially parallel with the base 48 while the semment 58 is inclined at any angle within a substantial range as referred to hereinbelow. In the example herein illustrated, the segment 58 may be on the order of $\frac{1}{8}$ the length of the spring finger, but this of course is not a limiting relation, but merely an example. The folded or creased end of the spring clip indicated at 60 may be considered the leading end of the spring clip in inserting the clip into the receptor. The opposite end 62 of the spring finger is free, that is, it is detached and free to be moved toward and from the base. When the spring clip is in position in the receptor, the spring finger engages the stop element 34, and the latter holds the spring clip in the receptor, as referred to again hereinbelow.

In the motion of inserting the spring clip, the abutment or camming surface 58 engages the release member 18 and assures that the release member will be moved to its retracted position (to the left FIGS. 3, 4) if it is not at that time in that position. This eliminates accidental wedging of the release member between the spring finger and the top wall of the receptor, as might occur in the case of a spring finger that is straight and gradually inclined. When it is desired to release the spring clip, the release member is gripped at the gripping elements 42 by the fingers, and it is pushed in advancing direction (to the right, FIGS. 3, 4) and as it engages the camming element 58, the inclination of the latter is such that the release member rides up on it and in that action depresses the spring finger to the position represented in FIG. 4, and the free end of the spring finger is moved down below the stop element 34 and thus the spring clip is unlocked and can be readily withdrawn. Stated in other words, the inclination of the element 58 is such that in the action of inserting the spring clip into the receptor, it acts as an abutment against the release member, and since the release member is small in mass and easily movable, it is moved back to retracted position. On the other hand, when the release member is gripped by the fingers and moved in advancing direction (to the right) the inclination of the element 58 is such that that element acts as a camming member and the release member depresses the spring finger. The segment 58 may be of any inclination within a substantial range in which it performs an effective camming function.

All of the elements of the clasp, are made of sheet metal fabricated to the desired shapes. The clasp is accordingly extremely inexpensive both as to the amount of material used, and the fabricating steps. Moreover, the clasp provides virtually absolute locking effect. it is easily put in locking position, and released therefrom. The spring clip is of such character that the spring finger thereof is prebiased to the desired extended or upper position and in its locked position (FIG. 3) it is spaced from the top wall element 32 as indicated at 64, and there is no stress applied thereto and hence the spring finger retains its original strength indefinitely. The design of the two parts, the receptor and the spring clip, is such that the spring finger and the base of the spring clip are of substantially the full width of the interior of the receptor, although easily slidable therein, and thus they provide maximum strength.

I claim:

1. A clasp comprising, two main parts (a) a receptor, (b) a spring clip, the receptor having an opening at one end and a downwardly directed stop element at the top of the opening, the spring clip having an end insertable into the opening, and including a bottom element and a spring finger return-bent about a curved interconnecting element, the spring finger being self-biased to an upper locking position in which it engages said stop element when the spring clip is in position in the receptor in response to its insertion thereinto, and thereby releasably locking the spring clip in place in locking position, receptor including a release member of small mass extending transversely therethrough and having ends exposed laterally of the receptor for gripping thereof by the fingers of the user, and slideable longitudinally of the receptor, from a retracted inactive position to an advanced operative position, and in so sliding, operative for camming the spring finger out of locking position, and the spring finger being made up of end portions that are substantially straight longitudinally, and an intermediate portion inclined at an abrupt angle to the longitudinal direction of the end portions, forming an abutment operative, pursuant to insertion of the spring clip into the receptor and consequent engagement with the release member, for moving the release member to retracted position, but functioning as a camming element in response to movement of the release member thereagainst and thereby enabling the release member to release it from locking position.

2. A clasp according to claim 1 wherein the receptor includes a box-like member circumferentially continuous transversely except for openings for the release member, and having an interior space that is clear and unobstructed in transverse direction, and the spring finger and bottom element are both of substantially the same width as the interior space of the receptor with a sliding fit

3. A clasp according to claim 2 wherein the box-like member and the spring clip each is made entirely of sheet metal fabricated to its final shape.

4. A clasp according to claim 3 wherein the release member also is made solely from a piece of sheet metal fabricated to its final shape.

* * * * *